US006058558A

United States Patent [19]

Kim

[11] Patent Number: 6,058,558

[45] Date of Patent: May 9, 2000

[54] AUXILIARY BRUSH HOLDER FOR A VACUUM CLEANER

[75] Inventor: Yong-Han Kim, Incheon, Rep. of Korea

[73] Assignee: Daewoo Electronics Co., Ltd., Seoul, Rep. of Korea

[21] Appl. No.: 09/053,153

[22] Filed: Apr. 1, 1998

[51] Int. Cl.[7] ..... A47L 5/00

[52] U.S. Cl. ..... 15/323; 15/339

[58] Field of Search ..... 15/323, 338, 339, 15/398, 415.1; 211/71.01, 85.18, 85.29, 86.01, 87.01

[56] References Cited

U.S. PATENT DOCUMENTS

| | | | |
|---|---|---|---|
| 2,649,606 | 8/1953 | Fadner | 15/323 |
| 2,825,087 | 3/1958 | Meyerhoefer | 15/323 |
| 3,872,538 | 3/1975 | Crouser . | |
| 4,697,299 | 10/1987 | Brinkhoff . | |
| 4,845,793 | 7/1989 | Meyer | 15/323 |
| 5,071,012 | 12/1991 | Jailor | 15/323 |
| 5,233,722 | 8/1993 | McKnight et al. . | |
| 5,826,299 | 10/1998 | Kim | 15/323 |

*Primary Examiner*—Robert J. Warden, Sr.
*Assistant Examiner*—Andrew Aldag
*Attorney, Agent, or Firm*—Pillsbury Madison & Sutro LLP

[57] ABSTRACT

An auxiliary brush holder for a vacuum cleaner which can hold a plurality of auxiliary brushes. The auxiliary brush holder has a frame having an opening into which an extension pipe is inserted, an extension bar which is integrally formed with a lower portion of a first end of the frame and extends downwards therefrom so as to be inserted into a receptacle formed at a body of the vacuum cleaner, and two arcuate ribs which are integrally formed at a lower portion of a second end of the frame and upwardly extend to an upper surface of the frame. The two arcuate grooves are defined between the two arcuate ribs and the second end of the frame and the arcuate ribs are regularly spaced out by a predetermined distance apart from each other. The auxiliary brush holder can hold a plurality of auxiliary brushes with simple construction, so the user can easily use the required auxiliary brush while the cleaning work is being carried out, thereby improving cleaning efficiency.

6 Claims, 3 Drawing Sheets

AUXILIARY BRUSH HOLDER FOR A VACUUM CLEANER

BACKGROUND OF THE INVENTION

1. Field of the Invention

The present invention relates to a vacuum cleaner, and more particularly to an auxiliary brush holder for a vacuum cleaner which can hold a plurality of auxiliary brushes.

2. Prior Art

A vacuum cleaner is an electrical appliance for removing dirt from carpets or floors by suction. Generally, the vacuum cleaner is classified as a canister type vacuum cleaner and an upright type vacuum cleaner.

In the upright type vacuum cleaner, a cleaner body section is integrally formed with a brush section so that the brush section moves together with the cleaner body section while cleaning. Therefore, the upright type vacuum cleaner does not occupy large space when stored or operated, and can be easily handled while cleaning.

In the canister type vacuum cleaner, a cleaner body section is separated from a brush section so that the brush section can separately move with respect to the cleaner body section while cleaning. Therefore, even when dust is collected on high places such as bookshelves, the user can easily remove dirt by simply moving the brush section onto the bookshelf without lifting the heavy cleaner body section.

When it is required to clean a specific place, such as a corner or a window sill, an auxiliary brush, such as a crevice tool or a floor brush, is assembled into an extension pipe instead of a brush head. Recently, in order to prevent the loss of the auxiliary brushes and in order to easily use the auxiliary brushes, vacuum cleaners capable of storing the auxiliary brushes therein have been developed.

FIG. 3 shows a conventional canister type vacuum cleaner 10 having a recess for storing the auxiliary brushes. As shown in the figure, conventional vacuum cleaner 10 has a body 1 provided at both sides thereof with wheels 6. Body 1 is formed at its inner portion with a dust collection chamber (not shown), in which a trash bag (not shown) is installed, and a blowing chamber (not shown) in which a blower assembly is installed.

Provided at a front wall of body 1 is a neck pipe 5 into which one end of a flexible hose 2 is inserted. The other end of flexible hose 2 is connected to an extension pipe (not shown) so as to guide impurities, such as dust, into the dust collecting chamber through a brush assembly (not shown).

In addition, body 1 is formed at an upper surface thereof with a recess 9 for storing the auxiliary brushes such as a floor brush 8 or a crevice tool 7. Cover 3 for preventing the auxiliary brushes from coming out of recess 9 is hinged to an upper portion of recess 9.

In conventional vacuum cleaner 10, when the blower assembly installed in the blowing chamber is driven, air including the impurities is sucked through the brush assembly. Then, the impurities are collected in the dust collecting chamber, and the filtered air is discharged out of vacuum cleaner 10.

When it is required to use the auxiliary brushes, the user picks up the auxiliary brushes from recess 9 by opening cover 3, so the user can easily use the auxiliary brushes.

However, since conventional vacuum cleaner 10 must form recess 9 on body 1, not only is the size of body 1 increased, but also it is difficult to manufacture body 1. In addition, the conventional vacuum cleaner 10 occupies a large space when stored.

On the other hand, U.S. Pat. No. 5,233,722 issued to McKnight discloses a vacuum cleaner having a tool storage arrangement which is formed at a front portion of a housing. However, since the tool storage arrangement is formed in the housing, the size of the vacuum cleaner is increased.

SUMMARY OF THE INVENTION

The present invention has been made to overcome the above described problems of the prior art, and accordingly it is an object of the present invention to provide an auxiliary brush holder for holding a plurality of auxiliary brushes which has a simple construction and can be easily manufactured.

In order to accomplish the above object, the present invention provides an auxiliary brush holder for a vacuum cleaner, the auxiliary brush holder comprising:

- a frame having an opening into which an extension pipe of the vacuum cleaner is inserted;
- an extension bar which is integrally formed with a lower portion of a first end of the frame and extends downwards therefrom, the extension bar being inserted into a receptacle formed at a front portion of a bottom wall of the vacuum cleaner so as to allow the vacuum cleaner to stand in an upright position; and
- a means for holding at least one auxiliary brush, the holding means being integrally formed at a periphery of a second end of the frame, the second end being opposite to the first end.

According to a preferred embodiment of the present invention, the holding means includes two arcuate ribs which are integrally formed at a lower portion of the second end of the frame and upwardly extend to an upper surface of the frame, and two arcuate grooves defined by the two arcuate ribs and the second end of the frame. The arcuate ribs are regularly spaced out by a predetermined distance apart from each other.

Each arcuate groove has a curvature identical to a curvature of the auxiliary brush, and each arcuate groove has a width smaller than a thickness of each auxiliary brush.

When it is required to use the auxiliary brushes, the user picks up the desired auxiliary brush from the auxiliary brush holder, so the user can easily use the auxiliary brushes.

When the cleaning work is completed, the extension bar of the auxiliary brush holder is inserted into a receptacle formed in a body section of the vacuum cleaner, so that the vacuum cleaner can be stored in an upright position.

The auxiliary brush holder of the present invention can hold a plurality of auxiliary brushes with simple construction, so the user can easily use the required auxiliary brush while the cleaning work is being carried out, thereby improving cleaning efficiency.

In addition, since the auxiliary brushes are kept in the auxiliary brush holder, loss of the auxiliary brushes is reduced. Furthermore, the user can rapidly replace the auxiliary brush with other auxiliary brushes.

BRIEF DESCRIPTION OF THE DRAWINGS

The above object and other advantages of the present invention will become more apparent by describing in detail a preferred embodiment thereof with reference to the attached drawings, in which.

DESCRIPTION OF THE PREFERRED EMBODIMENTS

Hereinafter, a preferred embodiment of the present invention will be described in detail with reference to the accompanying drawings.

Figure 1:
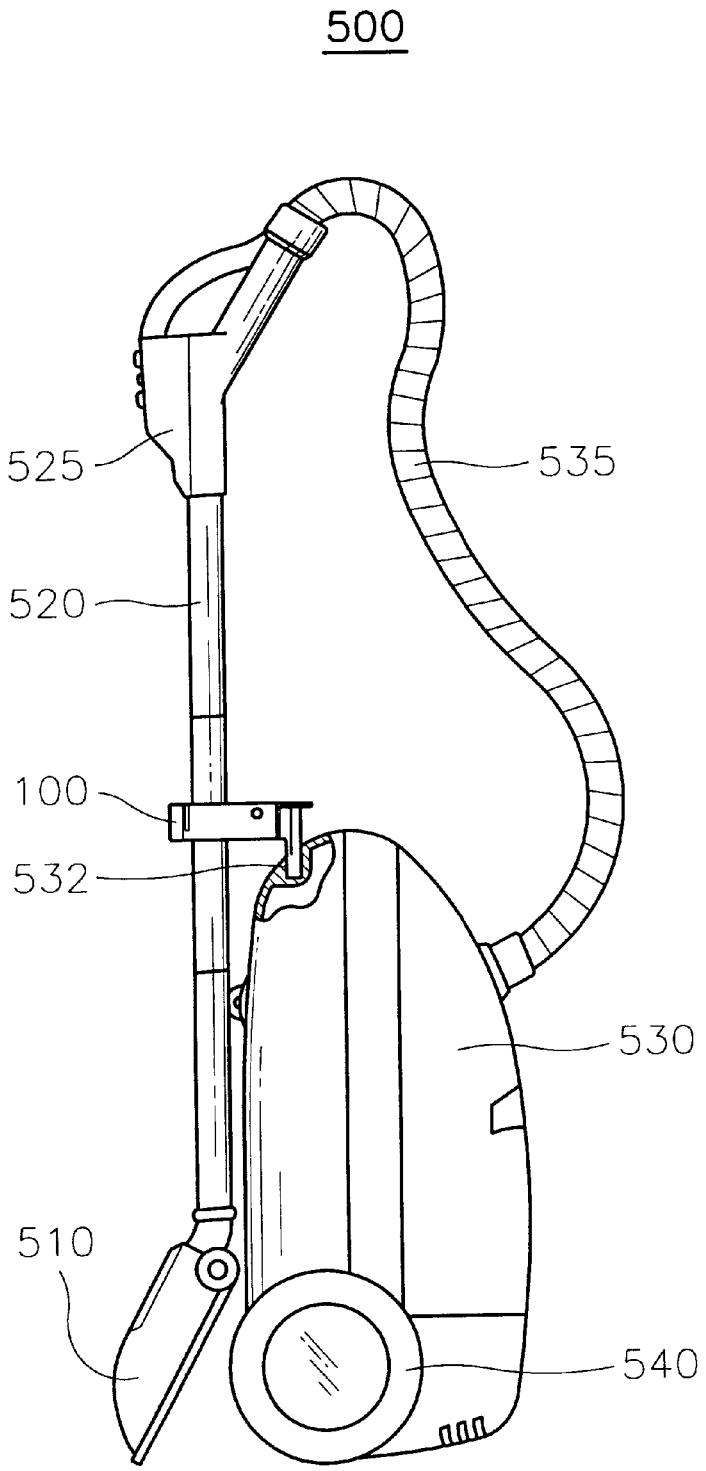
FIG. 1 is a side view showing a vacuum cleaner having an auxiliary brush holder according to one embodiment of the present invention.

FIG. 1 shows a vacuum cleaner 500 according to a preferred embodiment of the present invention.

Referring to FIG. 1, vacuum cleaner 500 has a brush assembly 510 for drawing in impurities, such as dust, an extension pipe 520 having a first end connected to brush assembly 510 and a second end provided with a handle portion 525, a body section 530 connected to handle portion 525 through a flexible hose 535, a wheel section 540 for moving body section 530, and an auxiliary brush holder 100 which is detachably coupled to extension pipe 520.

Body section 530 is formed at an inner portion thereof with a dust collecting chamber (not shown) in which a trash bag is installed and a blowing chamber (not shown) in which a blower assembly (not shown) is accommodated.

In addition, a receptacle 532, into which auxiliary brush holder 100 is partially inserted, is formed at a front portion of a bottom wall of body section 530. By coupling auxiliary brush holder 100 into receptacle 532, vacuum cleaner 500 can stand in an upright position, so vacuum cleaner 500 does not occupy a large space when stored.

Figure 2:
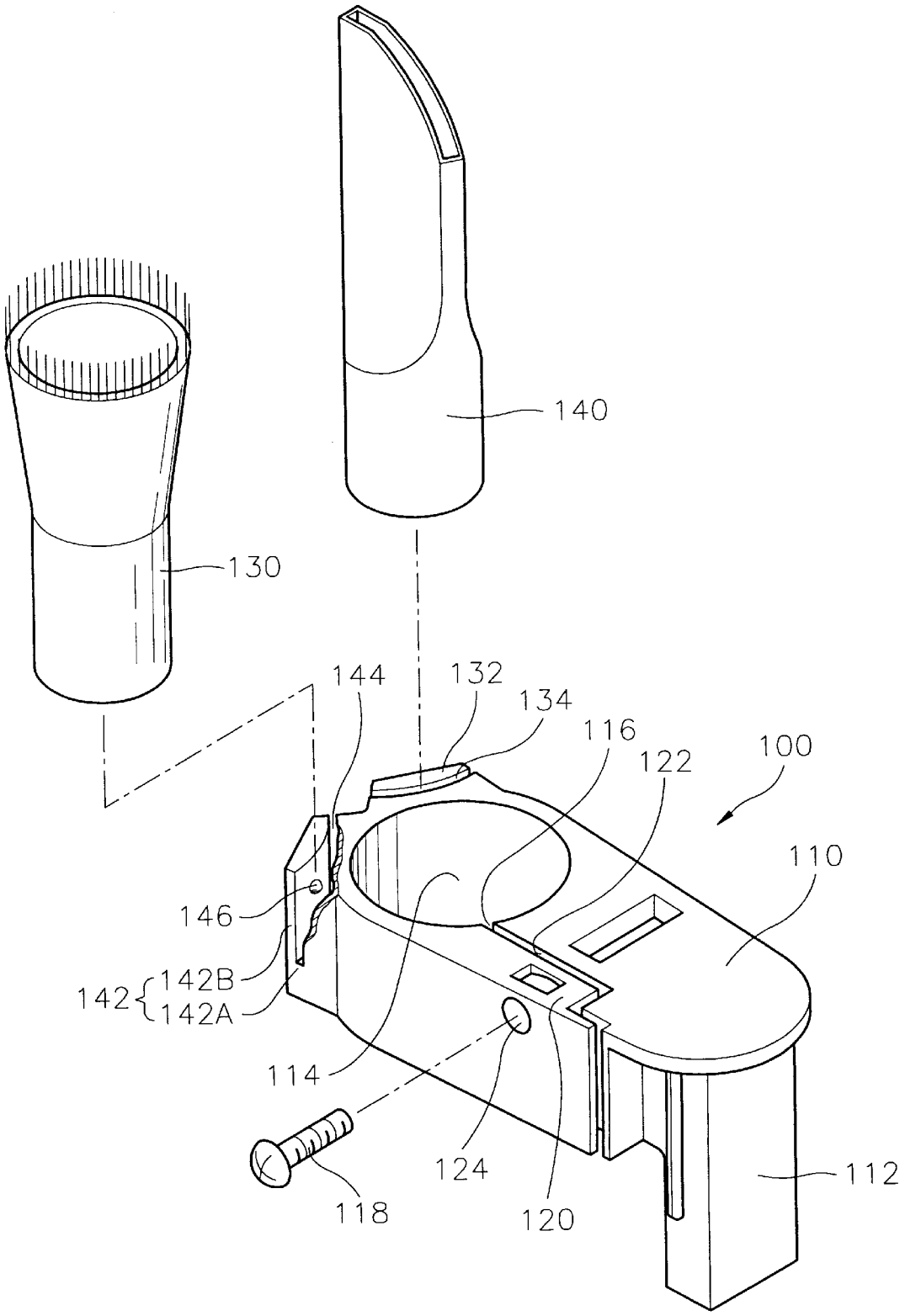
FIG. 2 is a perspective view showing the auxiliary brush holder shown in FIG. 1.
Figure 3:
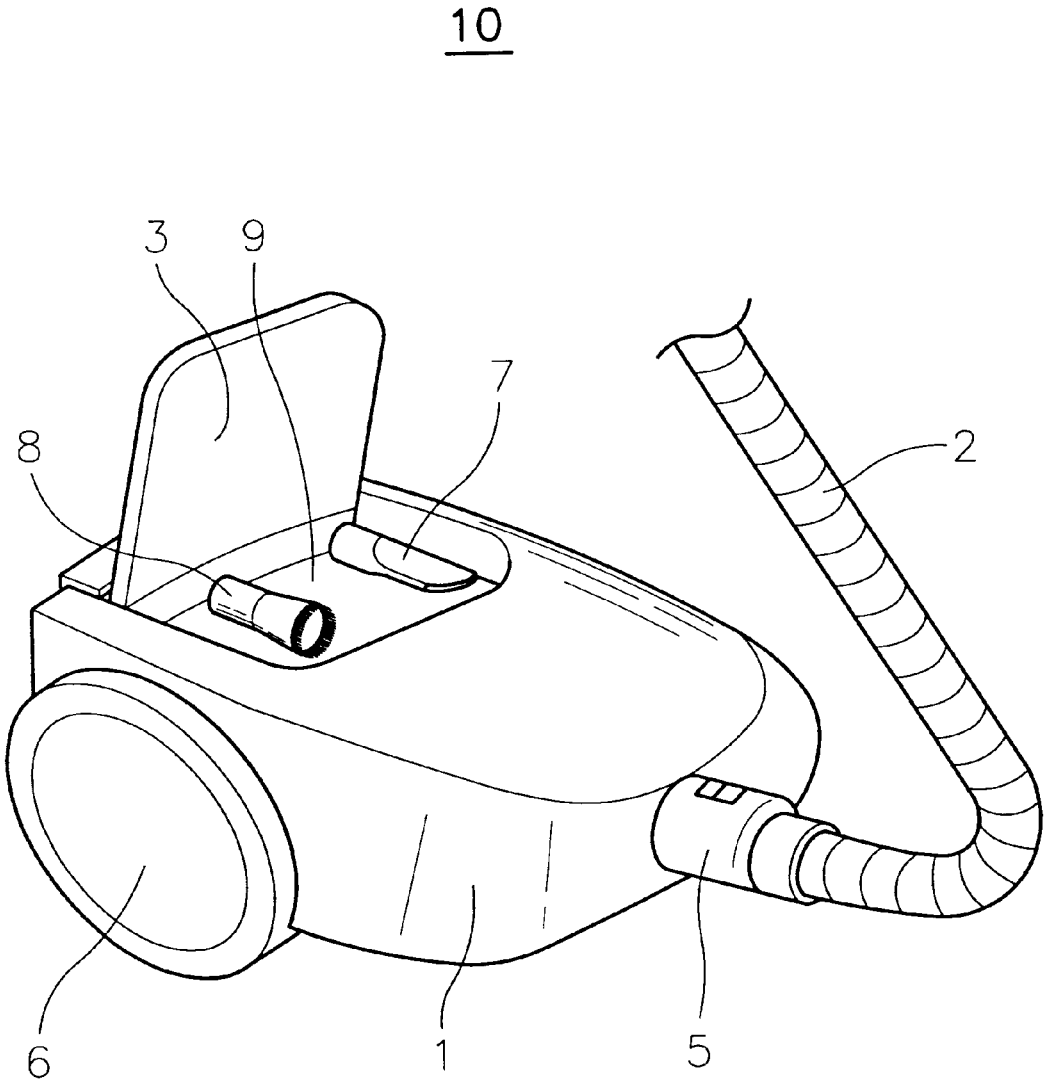
FIG. 3 (PRIOR ART)
FIG. 3 is a perspective view showing a conventional vacuum cleaner having a recess for storing the auxiliary brushes.

FIG. 2 shows auxiliary brush holder 100 according to one embodiment of the present invention.

As shown in FIG. 2, auxiliary brush holder 100 has a frame 110. Frame 110 has an opening 114 into which extension pipe 520 of vacuum cleaner 500 is inserted. In order to easily assemble frame 110 to extension pipe 520, a cutting portion 116 is formed at a predetermined position of opening 114. After assembling frame 110 to extension pipe 520, a free end 120 of frame 110 is fixed to a fixing portion 122 of frame 110 by means of a screw 118, so auxiliary brush holder 100 can be fixedly positioned on a predetermined portion of extension pipe 520. For that purpose, a screw hole 124 into which screw 118 is screw-coupled is formed in both free end 120 and fixing portion 122.

An extension bar 112 is integrally formed with a lower portion of a first end of frame 110. As is shown in detail in FIG. 1, extension bar 112 extends downwards and is inserted into a receptacle 532 formed at a front portion of a bottom wall of vacuum cleaner 500 so as to allow vacuum cleaner 500 to stand in an upright position.

Referring again to FIG. 2, at a lower portion of a second end of frame 110, there are integrally provided first and second arcuate ribs 132 and 142. First and second arcuate ribs 132 and 142 upwardly extend to an upper surface of frame 110. First and second arcuate grooves 134 and 144, into which the auxiliary brush such as a floor brush 130 or a crevice tool 140 is mounted, are formed between first and second arcuate ribs 132 and 142 and the second end of frame 110.

Second arcuate rib 142 consists of a horizontal portion 142A which is integrally formed with the lower portion of the second of frame 110 and a vertical portion B which extends upwards from horizontal portion 142A. Vertical portion b is spaced by a predetermined distance apart from frame 110. First arcuate rib 132 has the same construction as second arcuate rib 142.

In order to stably hold the auxiliary brush, first and second arcuate grooves 134 and 144 have a predetermined depth. Though two arcuate grooves 134 and 144 are shown in the figure, the present invention is not limited to that. For example, according to another embodiment of the present invention, frame 110 has a plurality of arcuate ribs forming a plurality of arcuate grooves. It is also possible to provide one arcuate rib in such a manner that one arcuate groove is formed between the arcuate rib and the frame.

First and second arcuate grooves 134 and 144 are spaced by a predetermined distance from each other in such a manner that the auxiliary brushes do not make contact with each other when they are inserted into first and second arcuate grooves 134 and 144, respectively. In addition, it is preferable to manufacture first and second arcuate ribs 132 and 142 with a flexible material so that the auxiliary brush can be easily inserted into first and second arcuate grooves 134 and 144.

Preferably, each arcuate groove has a curvature identical to a curvature of the auxiliary brush, and each arcuate groove has a width smaller than a thickness of the auxiliary brush. In this case, the auxiliary brush is press-fitted into the arcuate groove so that the auxiliary brush is prevented from separating from first and second arcuate grooves 134 and 144.

According to another embodiment of the present invention, first and second arcuate grooves 134 and 144 are integrally formed at an inner wall thereof with an elastic protrusion 146 for securely fixing the auxiliary brush. In this case, the auxiliary brush can be stably maintained in first and second arcuate grooves 134 and 144 even when the width of each first and second arcuate groove 134 and 144 is larger than the thickness of the auxiliary brush.

In the vacuum cleaner 500 according to the present invention, the impurities sucked through brush assembly 510 is introduced into body section 530 through extension pipe 520 and flexible hose 535. Then, the impurities are collected in the dust collecting chamber, and the air sucked with the impurities is filtered and is discharged out of vacuum cleaner 500.

When it is required to use the auxiliary brushes, the user picks up the desired auxiliary brush from auxiliary brush holder 100, so the user can easily use the auxiliary brushes.

When the cleaning work is completed, extension bar 112 of auxiliary brush holder 100 is inserted into a receptacle 532 formed in body section 530, so that vacuum cleaner 500 can be stored in an upright position.

As described above, the auxiliary brush holder of the present invention can hold a plurality of auxiliary brushes with simple construction, so the user can easily use the required auxiliary brush while the cleaning work is being carried out, thereby improving cleaning efficiency.

In addition, since the auxiliary brushes are kept in the auxiliary brush holder, loss of the auxiliary brushes is reduced. Furthermore, the user can rapidly replace the auxiliary brush with other auxiliary brushes.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. An auxiliary brush holder for a vacuum cleaner, the auxiliary brush holder comprising:

a frame having an opening into which an extension pipe of the vacuum cleaner is inserted;

an extension bar which is integrally formed with a lower portion of a first end of the frame and extends downwards therefrom, the extension bar being inserted into a receptacle formed at a front portion of a bottom wall of the vacuum cleaner so as to allow the vacuum cleaner to stand in an upright position; and a means for holding at least one auxiliary brush, the holding means being integrally formed at a periphery of a second end of the frame, the second end being opposite to the first end, the holding means including an arcuate rib which is integrally formed at a lower portion of the second end of the frame and upwardly extends to an upper surface of the frame, and an arcuate groove defined by the arcuate rib and the second end of the frame, the arcuate groove adapted for engaging the auxiliary brush.

2. An auxiliary brush holder for a vacuum cleaner, the auxiliary brush holder comprising:

a frame having an opening into which an extension pipe of the vacuum cleaner is inserted:

an extension bar which is integrally formed with a lower portion of a first end of the frame and extends downwards therefrom, the extension bar being inserted into a receptacle formed at a front portion of a bottom wall of the vacuum cleaner so as to allow the vacuum cleaner to stand in an upright position; and a means for holding at least two auxiliary brushes, the holding means being integrally formed at a periphery of a second end of the frame, the second end being opposite to the first end, the holding means including a plurality of arcuate ribs which are integrally formed at a lower portion of the second end of the frame and upwardly extend to an upper surface of the frame, and arcuate grooves defined by the arcuate ribs and the second end of the frame, the arcuate ribs being regularly spaced out by a predetermined distance apart from each other, each of the arcuate grooves adapted for engaging one of the auxiliary brushes.

3. An auxiliary brush holder for a vacuum cleaner, the auxiliary brush holder comprising:

a frame having an opening into which an extension pipe of the vacuum cleaner is inserted;

an extension bar which is integrally formed with a lower portion of a first end of the frame and extends downwards therefrom, the extension bar being inserted into a receptacle formed at a front portion of a bottom wall of the vacuum cleaner so as to allow the vacuum cleaner to stand in an upright position; and a means for holding two auxiliary brushes, the holding means being integrally formed at a periphery of a second end of the frame, the second end being opposite to the first end, the holding means including two arcuate ribs which are integrally formed at a lower portion of the second end of the frame and upwardly extend to an upper surface of the frame, and two arcuate grooves defined by the two arcuate ribs and the second end of the frame, the arcuate ribs being regularly spaced out by a predetermined distance apart from each other, each of the arcuate grooves adapted for engaging one of the auxiliary brushes.

4. The auxiliary brush holder as claimed in claim 3, wherein the arcuate ribs are made of a flexible material.

5. The auxiliary brush holder as claimed in claim 3, wherein each arcuate groove has a first curvature identical to a second curvature of one of the auxiliary brushes.

6. The auxiliary brush holder as claimed in claim 5, wherein each of the arcuate grooves is adapted to engage one of the auxiliary brushes in a press-fit.

* * * * *